US006420947B2

(12) United States Patent
Broad et al.

(10) Patent No.: US 6,420,947 B2
(45) Date of Patent: Jul. 16, 2002

(54) THERMAL COMPENSATION ARRANGEMENT FOR MICROWAVE FILTER

(75) Inventors: Graham Broad, Lilydale; Lewis Steer, Mooroolbark, both of (AU)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/816,466

(22) Filed: Mar. 26, 2001

(30) Foreign Application Priority Data

Mar. 28, 2000 (AU) ..... PR2952
Jan. 31, 2001 (AU) ..... 18237/01

(51) Int. Cl.[7] ..... H01P 1/208; H01P 7/06
(52) U.S. Cl. ..... 333/202; 333/229; 333/234
(58) Field of Search ..... 333/229, 227, 333/208, 212, 202, 234

(56) References Cited

U.S. PATENT DOCUMENTS 5,714,920 A * 2/1998 Ivanov et al. ..... 333/219.1
5,867,077 A 2/1999 Lundquist ..... 333/208

OTHER PUBLICATIONS

Patent Abstracts of Japan, vol. 006, No. 119 (E–116), Jul. 3, 1982 corresponding to JP 57 046501 A (NEC Corp), Mar. 17, 1982.

* cited by examiner

*Primary Examiner*—Justin P. Bettendorf
*Assistant Examiner*—Stephen E. Jones
(74) *Attorney, Agent, or Firm*—Sughrue Mion, PLLC

(57) ABSTRACT

This invention discloses an improved thermal compensation arrangement for a microwave filter of the type comprising at least one cavity defined by a metal side wall having a low coefficient of thermal expansion, such as invar, and light-weight metal end walls, such as aluminum, having good thermal and electrical conductivity, but a high coefficient of thermal expansion. The present invention comprises a characteristic arrangement of annular grooves and slots in the end walls that mechanically isolate the end walls from the side wall fixed thereto, to avoid distortion of the cavity with changes in temperature.

9 Claims, 4 Drawing Sheets

THERMAL COMPENSATION ARRANGEMENT FOR MICROWAVE FILTER

TECHNICAL FIELD

This invention relates to microwave filters and in particular to a microwave cavity filter having a thermal compensation arrangement.

BACKGROUND OF THE INVENTION

With increasing demands on the radio frequency spectrum, microwave cavity filters are required to be highly selective. In order to ensure high selectivity, the filter's electrical characteristics must be maintained during temperature fluctuations.

If a microwave cavity filter having one or more cavities is made from a material having a high coefficient of thermal expansion, such as aluminium, a change in operating temperature causes dimensional changes to the filter. In order to maintain electrical characteristics of the filter when its dimensions change, it is known to provide a temperature compensating arrangement to compensate for the resulting resonant frequency shift.

It is also known to construct a cavity filter from a material having a low coefficient of thermal expansion such as Invar, a combination of nickel and iron. Filters made from this material provide very stable characteristics over a broad temperature range. However, it is not always practical to use filters made of invar because of the relatively heavy weight. Moreover, the thermal conductivity of invar is relatively poor which is a disadvantage in high power applications.

In order to avoid some of the drawbacks of filters made entirely of Invar, it is known to provide a filter arrangement in which the filter's cavities comprise side walls of Invar and end walls of aluminium. Because of the difference between the coefficient of thermal expansion of the side walls and that of the end walls in this known type of arrangement, temperature compensation must be provided. One known method of providing temperature compensation to these filter arrangements is to provide the end walls with projections that extend into the filter's cavities to reduce the volume change of a cavity that would otherwise occur due to expansion or contraction of the side walls with changes in temperature.

DISCLOSURE OF THE INVENTION

It is an object of the present invention to provide a relatively simple temperature compensating structure for a microwave cavity filter comprising at least one cavity having a side wall of a material having a low coefficient of thermal expansion and two end walls of a material having a relatively high coefficient of thermal expansion.

According to the invention there is provided a microwave filter comprising at least one cavity defined by a cylindrical side wall and two planar end walls having two opposite major surfaces whose perimeters are respectively attached by attachment means to an outwardly extending flange means at each end of said side wall, said side wall being made from a metallic material having a low coefficient of thermal expansion and said two end walls being made from a metallic material having a relatively high coefficient of thermal expansion, wherein a first continuous annular groove of a predetermined depth and a predetermined minimum width is provided in one major surface of each end wall proximate its perimeter, and a second continuous annular groove of predetermined depth and a predetermined minimum width is provided in the other major surface of each end wall proximate said perimeter, the diameter of said first annular groove being greater than the diameter of said second annular groove whereby a solid intermediate zone of predetermined width lies between the first and second annular grooves, and wherein a plurality of open ended slots of predetermined minimum width are provided in each said planar end wall at its perimeter, said slots extending from proximate said first annular groove to the outer boundary of said planar end wall.

BRIEF DESCRIPTION OF THE DRAWING

In order that the invention may be readily carried into effect, an embodiment thereof will now be described in relation to the accompanying drawings, in which.

BEST METHOD FOR CARRYING OUT THE INVENTION

Figure 1:
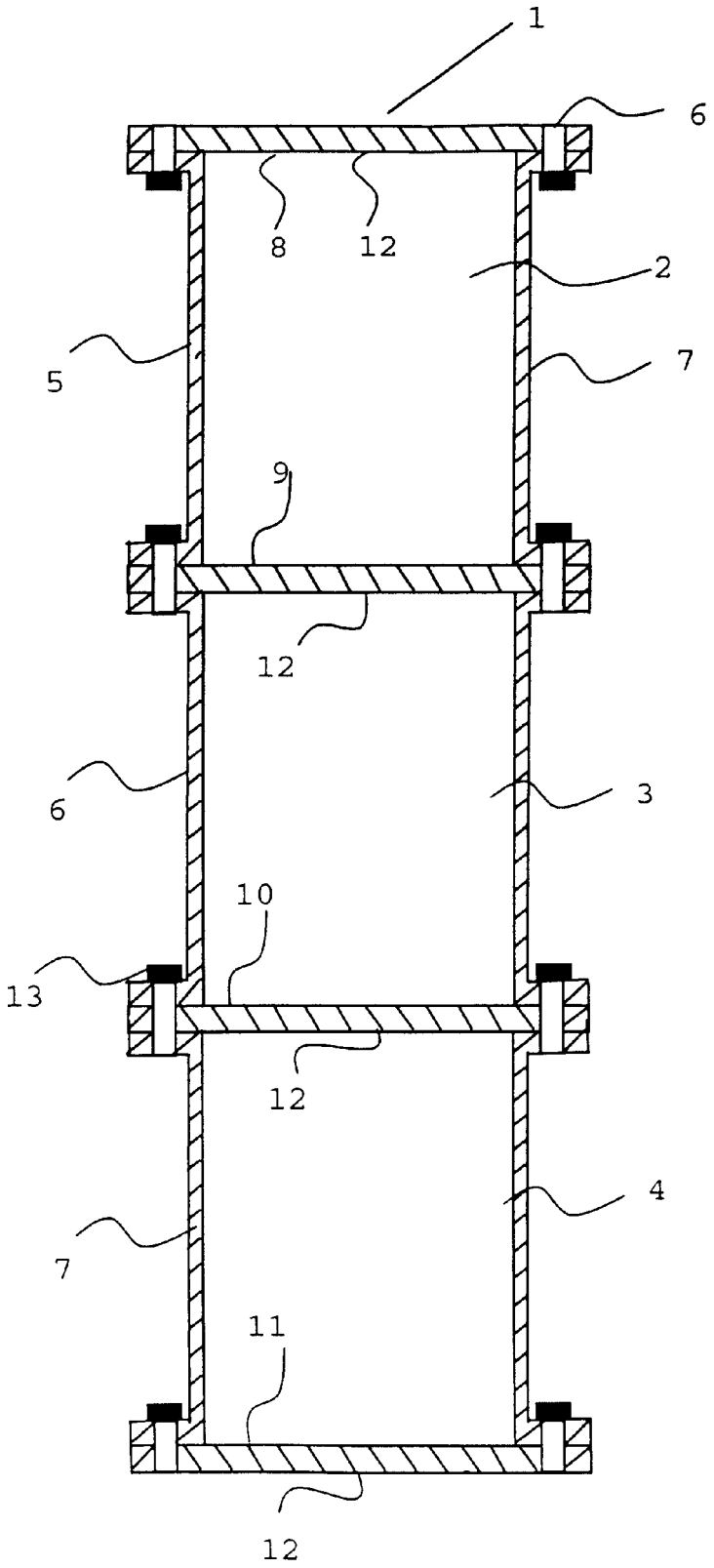
FIG. 1 shows a sectional side view of a three cavity filter.

Referring to the drawings, in FIG. 1, a filter 1 comprises three waveguide cavities 2,3 and 4. Each cavity is defined by a circular cylindrical wall 5,6 and 7, and circular end walls 8, 9, 10 and 11. Intermediate end walls 9 and 10 each contain a central aperture 12. Each circular cylindrical wall is made of a metal having a low coefficient of thermal expansion, such as, for example, Invar, and each end wall is made of a metal having a relatively high coefficient of thermal expansion and good thermal and electrical conductivity, such as, for example, aluminium. Preferably, the circular cylindrical walls and the end walls are silver plated. Filter 1 is assembled by screwing together the circular cylindrical walls and the end walls with screws 13.

Figure 2:
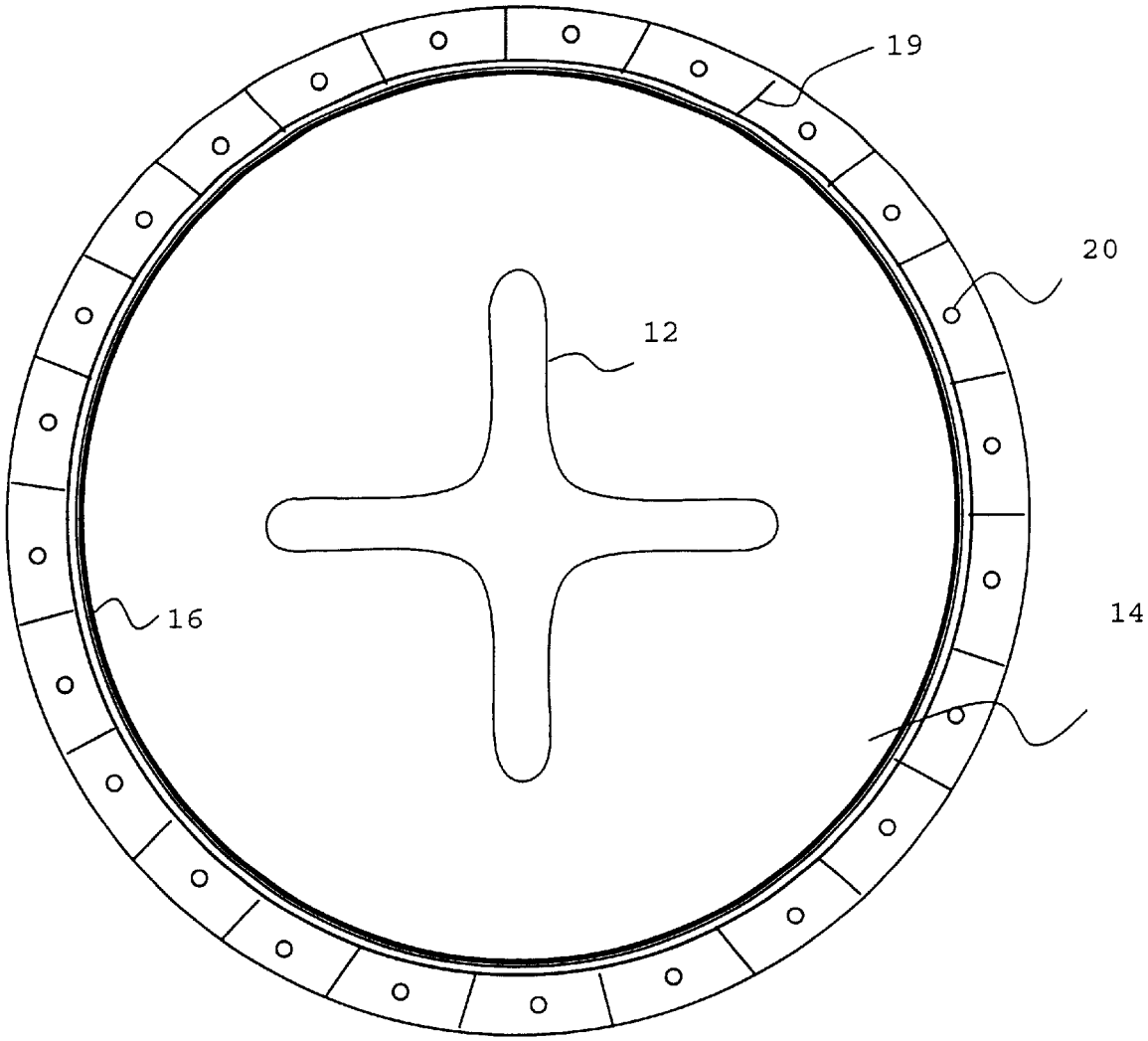
FIG. 2 shows a plan view of one side of an end wall.
Figure 3:
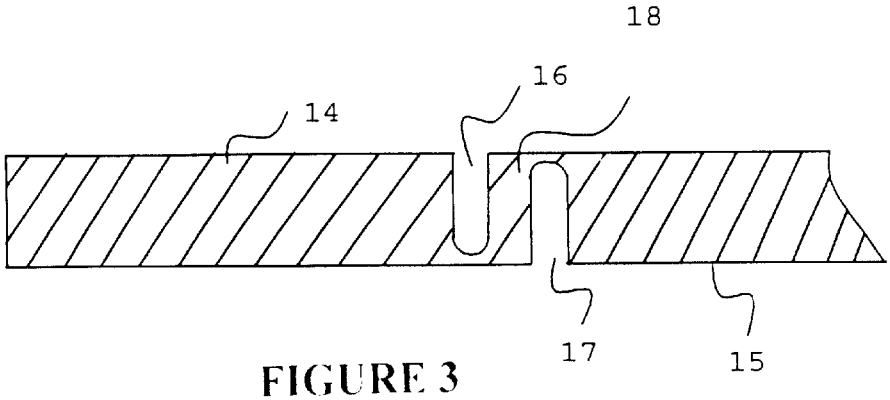
FIG. 3 shows a cross sectional view of an outer region of the end wall shown in FIG. 2.
Figure 4:
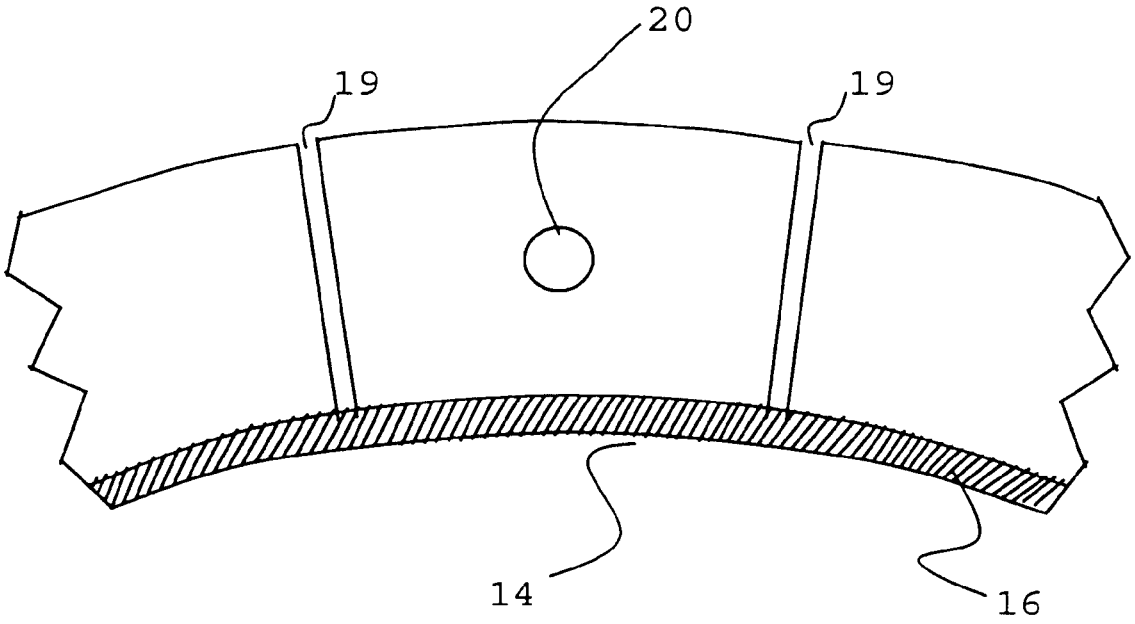
FIG. 4 shows a top, partial view of the outer region of an end wall.
Figure 4A:
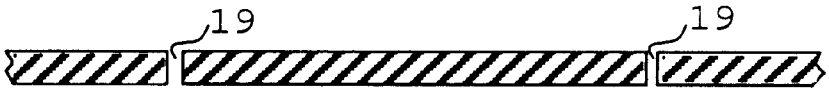
FIG. 4*a* shows a side, partial view of the outer region shown in FIG. 5.

In FIGS. 2 and 3, an end wall comprises a first surface 14 and an opposite surface 15. In each of these surfaces is provided a continuous annular groove 16 and 17 of predetermined depth; the diameter of one groove being different to the diameter of the other groove in order to provide an annular intermediate zone of metal 18 whose width is selected to provide the zone with, on the one hand, sufficient mechanical flexibility and, on the other hand good thermal conductivity. The perimeter of the end wall is provided with a plurality of outwardly extending open ended slots 19 that extend from the annular groove having a larger diameter to the outer boundary of the end wall. Through holes 20 for cooperation with screws 13 are provided between the open-ended slots. Conveniently, the open ended slots are radial. The aforementioned arrangement of grooves and outwardly extending slots is substantially the same for each end wall.

When providing the annular grooves 16 and 17 and the slots 19, the minimum width of the slots and grooves must be such that a space is always maintained between opposite surfaces of the respective grooves and slots throughout the expected operating temperature of the filter. This minimum width is determined by the temperature co-efficient of the material from which the end walls are made, and the expected operating temperature of the filter.

In operation the grooves 16 and 17 and the slots 19 mechanically isolate the aluminium end walls from the invar side walls and prevent any deformation in the end walls, caused by temperature changes, from being transferred to the Invar side walls, thereby maintaining cavity dimensions.

Figure 5:
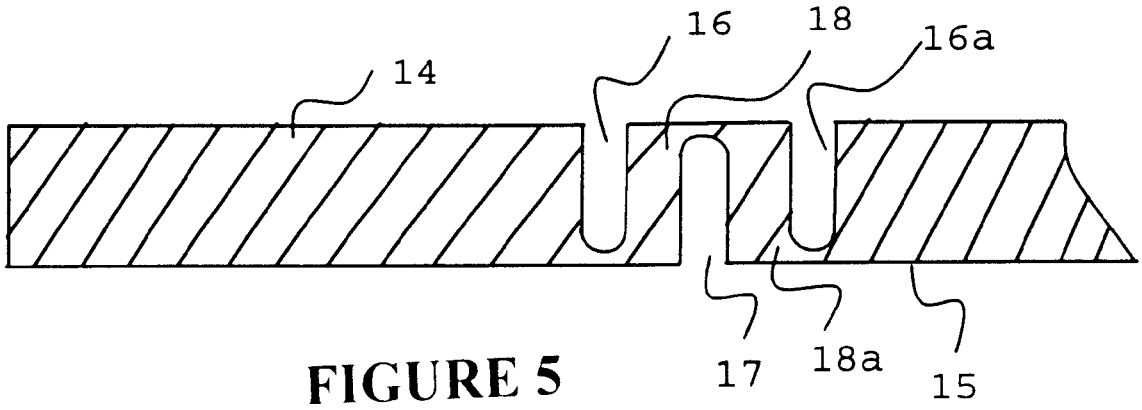
FIG. 5 shows a cross sectional view of an end wall incorporating an additional annular groove in one surface.

Referring to FIG. 5, in a further embodiment an additional continuous annular groove 16*a* is provided in the first surface 14 of the end wall. The diameter of groove 16*a* is less than the diameter of annular groove 17 in the second surface 15. This arrangement forms two concentric intermediate zones of metal 18 and 18*a*. In another embodiment (not shown) a plurality of grooves can be provided in surfaces 14 and 15 to form a plurality of intermediate zones.

The arrangement of the present invention allows the use of relatively thick aluminium end walls having good thermal conductivity thereby providing the filter with a high power rating. Such a filter may be required, for example, as a waveguide directional filter for a high power UHF TV applications.

The claims defining the invention are as follows:

1. A microwave filter comprising at least one cavity defined by a cylindrical side wall and two planar end walls having two opposite major surfaces whose perimeters are respectively attached by attachment means to an outwardly extending flange means at each end of said side wall, said side wall being made from a metallic material having a low coefficient of thermal expansion and said two end walls being made from a metallic material having a relatively high coefficient of thermal expansion, wherein a first continuous annular groove of a predetermined depth and a predetermined minimum width is provided in one major surface of each end wall proximate its perimeter, and a second continuous annular groove of predetermined depth and a predetermined minimum width is provided in the other major surface of each end wall proximate said perimeter, the diameter of said first annular groove being greater than the diameter of said second annular groove whereby a solid intermediate zone of predetermined width lies between the first and second annular grooves, and wherein a plurality of open ended slots of predetermined minimum width are provided in each said planar end wall at its perimeter, said slots extending from proximate said first annular groove to the outer boundary of said planar end wall.

2. A microwave filter as claimed in claim 1, wherein a further annular concentric groove of predetermined depth and a predetermined minimum width is provided in said one major surface, whose diameter is less than the diameter of said second continuous annular groove, whereby two solid intermediate zones of predetermined width lie between said first and further said grooves.

3. A microwave filter as claimed in claim 1, wherein a plurality of concentric first continuous annular grooves of a predetermined depth and predetermined minimum widths are provided in said one major surface, and a plurality of concentric second continuous annular grooves of a predetermined depth and predetermined minimum widths are provided in said other major surface such that a plurality of solid intermediate zones of predetermined width lie between adjacent said first and second annular grooves.

4. A microwave filter as claimed in claim 1, wherein said end walls are made from aluminium.

5. A microwave filter as claimed in claim 1, wherein said side wall is made from a combination of nickel and iron.

6. A microwave filter as claimed in claim 1, wherein said side wall and said end walls are silver plated.

7. A microwave filter as claimed in claim 1, wherein said cylindrical side wall and two planar end walls of said at least one cavity are substantially circular.

8. A microwave filter as claimed in claim 1, for use in high power UHF-TV applications.

9. A microwave filter as claimed in claim 1, wherein said filter is a wave guide directional filter.

* * * * *